US009022732B2

(12) United States Patent
Prunieres et al.

(10) Patent No.: US 9,022,732 B2
(45) Date of Patent: May 5, 2015

(54) CONCRETE VOLUTE PUMP

(71) Applicant: Alstom Technology Ltd, Baden (CH)

(72) Inventors: Romain Julien Mathieu Prunieres, Saint-Cloud (FR); Florent Longatte, Rambouillet (FR); Franvois-Xavier Catelan, Aulnay sur Mauldre (FR)

(73) Assignee: Alstom Technology Ltd., Baden (CH)

( * ) Notice: Subject to any disclaimer, the term of this patent is extended or adjusted under 35 U.S.C. 154(b) by 0 days.

(21) Appl. No.: 13/632,690

(22) Filed: Oct. 1, 2012

(65) Prior Publication Data

US 2013/0028719 A1 Jan. 31, 2013

Related U.S. Application Data

(63) Continuation of application No. PCT/EP2011/054853, filed on Mar. 29, 2011.

(30) Foreign Application Priority Data

Apr. 1, 2010 (FR) ..... 10 52471

(51) Int. Cl.
*F04D 29/02* (2006.01)
*F04D 29/44* (2006.01)
*F04D 29/60* (2006.01)

(52) U.S. Cl.
CPC ..... *F04D 29/026* (2013.01); *F04D 29/448* (2013.01); *F04D 29/606* (2013.01); *F05C 2211/00* (2013.01)

(58) Field of Classification Search
USPC ..... 415/191, 203, 208.1, 208.2, 211.2, 204, 415/206, 208.3, 208.4
See application file for complete search history.

(56) References Cited

U.S. PATENT DOCUMENTS

| | | | | |
|---|---|---|---|---|
| 1,107,591 | A | 8/1914 | DeHuff | |
| 1,476,210 | A | 12/1923 | Moody | |
| 1,530,569 | A | 3/1925 | Moody | |
| 3,186,685 | A * | 6/1965 | Desbaillets et al. | 415/208.3 |
| 3,191,539 | A * | 6/1965 | Davenport | 415/148 |
| 3,243,102 | A * | 3/1966 | McMahan | 415/208.2 |

(Continued)

FOREIGN PATENT DOCUMENTS

| | | | |
|---|---|---|---|
| DE | 3440635 | A1 | 5/1986 |
| FR | 735684 | A | 11/1932 |

(Continued)

OTHER PUBLICATIONS

Russian Office Action dated Feb. 27, 2014 issued in Russian Application No. 2012146505/06 with an English translation thereof.

*Primary Examiner* — Dwayne J White
*Assistant Examiner* — Justin Seabe
(74) *Attorney, Agent, or Firm* — Buchanan Ingersoll & Rooney PC

(57) ABSTRACT

A centrifugal pump is provided capable of pumping liquid volume flow rates of at least 20 m3/sec. The pump includes a centrifugal impeller rotatable about an axis and operable to direct a liquid towards a concrete volute arranged around the impeller. The pump further includes fixed fin-like elements arranged between the impeller and the volute. The elements form a discontinuous barrier around the impeller and are effective to reduce uneven radial thrusts exerted by the water on the centrifugal impeller, while limiting the water flow rate in a simple and economic manner.

12 Claims, 2 Drawing Sheets

(56) References Cited

U.S. PATENT DOCUMENTS

| | | | | |
|---|---|---|---|---|
| 4,720,238 | A | 1/1988 | Daux | |
| 4,824,325 | A * | 4/1989 | Bandukwalla | 417/211 |
| 5,228,832 | A * | 7/1993 | Nishida et al. | 415/208.1 |
| 5,709,531 | A * | 1/1998 | Nishida et al. | 415/208.2 |
| 6,820,333 | B2 | 11/2004 | Shimmei et al. | |

FOREIGN PATENT DOCUMENTS

| | | |
|---|---|---|
| FR | 1174557 A | 3/1959 |
| FR | 2593246 A1 | 7/1987 |

* cited by examiner

CONCRETE VOLUTE PUMP

CROSS REFERENCE TO CORRESPONDING APPLICATIONS

The present application is a Continuation of International Patent Application No. PCT/EP2011/054853, filed Mar. 29, 2011, which claims priority under to French Patent application number 1052471, filed Apr. 1, 2010, the entire contents of all of which are hereby incorporated by reference.

FIELD OF INVENTION

The present invention relates to a concrete volute pump capable of pumping very large volume flow rates of liquid. In particular, such a pump may be used for circulating water around the cooling and steam generating plant in large power stations.

BACKGROUND

It should be appreciated that in this disclosure the term "concrete volute pump" means a centrifugal pump that has a volute or scroll whose wall comprises concrete. Concrete volute pumps constitute an effective technical solution for pumping large quantities of water or other liquids at very high flow rates. Such pumps for use in large power plants may attain volume flow rates of 20 to 40 cubic meters of water per second or even more, for total heads of water of up to 35 meters or more.

This type of pump comprises a bladed rotor or impeller which acts on the liquid by making use of centrifugal force to accelerate it, and a collector, or volute, disposed around the impeller. The liquid to be pumped typically enters the pump axially via an inlet pipe of the pump coaxial with the impeller shaft, and the flow is discharged via the blades towards the periphery of the impeller and into the volute.

The volute is a fixed body, with increasing cross-section towards its outlet, in which progressive retardation of the liquid discharged from the centrifugal impeller converts the kinetic energy of the liquid to pressure. The volute channels the liquid to its outlet and reduces turbulence and velocity of the liquid.

Because of the high liquid pressures prevailing in concrete volute pumps and the asymmetry of the volute, a radial thrust, perpendicular to the impeller shaft, is exerted on the impeller. The radial thrust gives rise to deflection of the impeller shaft, which may give rise to contacts between the impeller and adjacent static components. Such contacts may result in a major deterioration in the condition of the equipment as well as a loss of sealing of the pump and reduced rate of delivery.

Another problem that may arise in a concrete volute pump is damage to the concrete caused by the very high flow rates of the liquid circulating in the volute.

There are various prior art solutions that enable one or other of these problems to be resolved.

Regarding the problem of the radial thrust of the liquid on the impeller, a method is known for using one or more hydrodynamic bearings or ball bearings designed to render the impeller shaft more rigid, such bearings typically being located halfway along the shaft. However, this solution adds to manufacturing cost and requires additional maintenance work.

A method is also known for using dual concrete volute pumps to reduce the radial thrust on the impeller. These pumps suffer from the disadvantage that they are expensive and provide only a low delivery rate.

Moreover, the above two solutions do not solve the problem of wear of the concrete under the action of the flow rate.

As regards the problem of wear of the concrete, a method is known for using metal shields in the areas of the volute where the fluid flow rate is at its highest. The implementation of this solution is a complex and onerous task and does not solve the problem of radial thrust exerted on the impeller.

The present invention is intended to eliminate or reduce these disadvantages. The invention proposes, in particular, a concrete volute pump that reduces the unevenness of the radial thrust exerted on the impeller, whilst limiting the wear of the concrete in a simple, economic manner.

SUMMARY

The present disclosure is directed to a concrete volute pump, configured to pump liquid at volume flow rates of at least 20 m3/sec. The pump includes a centrifugal impeller having blades. The impeller is arranged for rotation about an axis and is operable to direct a liquid towards a concrete volute arranged around the impeller. The pump further includes fixed elements arranged between the impeller and the volute. The fixed elements form a discontinuous barrier around the impeller.

BRIEF DESCRIPTION OF THE DRAWINGS

Other characteristics and advantages of the present invention are explained in greater detail in the following description given by way of illustrative and non-limiting example with reference to the attached drawings, in which.

DETAILED DESCRIPTION OF THE PREFERRED EMBODIMENTS

Introduction to the Embodiments

Figure 1:
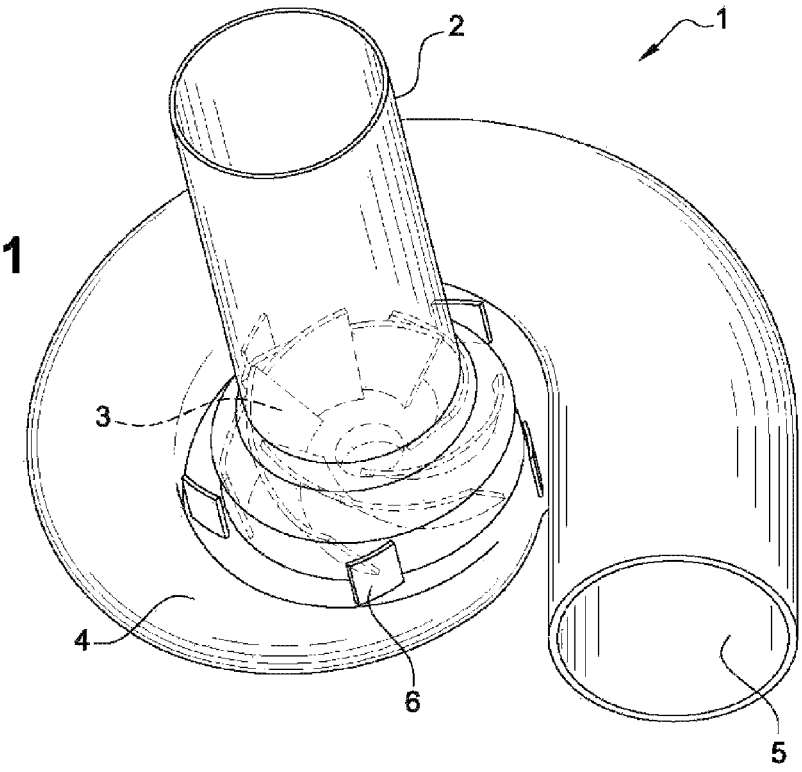
FIG. 1 is a perspective view of a concrete volute pump according to the invention.

The invention relates to a concrete volute pump, capable of pumping very large liquid volume flow rates of at least 20 $m^3$/sec, comprising a bladed rotor in the form of a centrifugal impeller that rotates about an axis and is operable to impel a liquid into a concrete volute arranged around the impeller, the pump further comprising fixed elements arranged between the impeller and the volute and forming a discontinuous barrier around the impeller.

Preferably, the pump should be capable of pumping liquid at volume flow rates of up to at least 40 $m^3$/sec.

The fixed elements form a discontinuous barrier around the impeller, and are effective to reduce the magnitude of pressure variations around the periphery of the impeller. This homogenization of the liquid pressure around the impeller reduces the overall unevenness of the radial thrust exerted by the fluid on the impeller due to the asymmetry of the volute. Moreover, the presence of an annular space between the impeller and the volute for the arrangement of the fixed elements reduces the flow rate of the liquid in the volute.

The fixed elements are preferably equi-angularly spaced around the impeller, which favors a reduction in peak radial thrust. By equi-angularly spaced is meant that the angle between two straight lines drawn from the impeller's rotational axis and connecting two adjacent fixed elements is essentially constant all around the impeller. Each angle may advantageously be equal to the mean angle of distribution (360°) divided by the number of fixed elements) ±10%, preferably ±5%.

Preferably, the fixed elements are arranged equidistantly from the impeller's axis, although this distance may vary by one or two percent relative to an average distance.

The fixed elements should comprise bodies each having a height dimension that extends generally spanwise across the outlet of the impeller, a width dimension that extends generally streamwise in the liquid flow and a thickness dimension that is smaller than the height and width dimensions. Hence, the fixed elements may be described as streamwise curved partitions or fins, arranged so that their major dimensions are generally aligned with the flow of the fluid coming from the impeller, thus avoiding disturbing the flow, which ensures better pump delivery. For each fixed element the angle of inclination relative to the direction of flow is preferably less than 2°, and more preferably less than 1°.

The number of blades on the impeller and the number of fixed elements should be coprime to prevent vibrations, i.e., their respective numbers should not have a common divisor. Additionally, to avoid disturbances between the blades and the fixed elements, more particularly rotating pressure patterns, the number of blades and the number of fixed elements should preferably differ by more than one.

The volute preferably has a circular cross-section in order to limit the space occupied compared to a volute which has a rectangular section.

DETAILED DESCRIPTION

In FIG. 1, concrete volute pump 1 is seen from below, with hidden components shown in dashed lines, and comprises an inlet water pipe 2, a centrifugal impeller 3, a volute 4, and an outlet pipe 5.

Inlet pipe 2 channels water to the centrifugal impeller 3. Pipe 2 is, e.g., cylindrical and straight, but could also be an elbow shape to turn the water through an angle before it enters the impeller. Centrifugal impeller 3 and water inlet pipe 2 at the entry to the impeller are coaxial. A motor shaft, not shown, is connected to the centrifugal impeller 3 along a vertical axis to drive the impeller 3 so that as it rotates the water is centrifuged outwards towards the periphery of the impeller.

The water then flows into and through volute 4, which is a conduit whose cross-section increases from a minimum at a radially inner nozzle 7 (see FIG. 2) until it reaches a maximum at cylindrical outlet pipe 5. The divergent cross-section of the volute acts to convert the momentum of the water coming out of the periphery of the impeller into a pressure head.

In the present exemplary embodiment, five fins 6 are equiangularly spaced around the circumference of impeller 3, between the impeller and the volute 4. Fins 6 may, in particular, be fixed to upper and lower metal walls, not shown, these walls being two parallel annular walls fixed to the volute. In the present example, the angle between two straight lines drawn from the rotational axis of centrifugal impeller 3 and connecting two adjacent fins 6 is about 72°, but may vary between 69° and 75°. A plurality of fins should be used, preferably from three to fifteen fins or more, and more preferably from three to eleven fins, the choice being made to achieve a good compromise between increasing construction cost and the reduction in peak radial thrust on the impeller with increasing numbers of fins 6.

The uneven radial thrust on the impeller of a centrifugal pump with a volute is caused by poor distribution of the pressure around the impeller due to the asymmetry of the volute. In the present embodiment, fins 6 compensate for the asymmetry of volute 4 by tending to homogenize the water pressure around centrifugal impeller 3 so that the resultant radial thrust exerted on centrifugal impeller 3 is greatly reduced.

Figure 2:
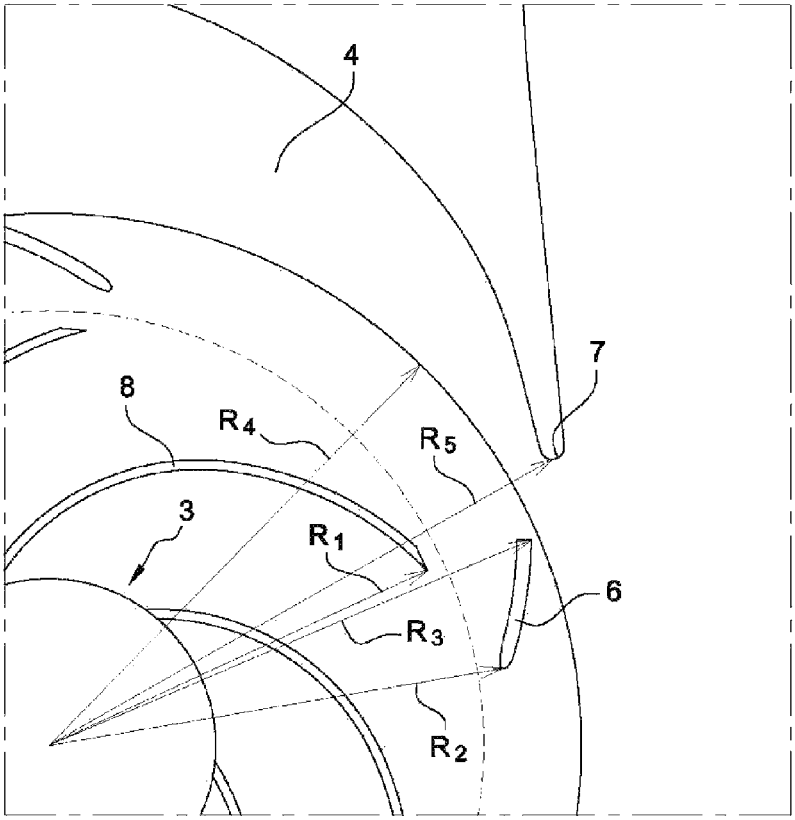
FIG. 2 is a cross-sectional plan view of a part of the pump.

FIG. 2 is a sectional plan view of part of the device extending between centrifugal impeller 3 and nozzle 7 of volute 4. The volute nozzle 7 is the part of volute 4 which has the smallest cross-section and which is closest to impeller 3 with blades 8.

$R_1$ denotes the exit radius of impeller 3 from blades 8. This is the distance from the rotational axis of impeller 3 to the ends of blades 8 furthest away the axis. The distance from the rotational axis of impeller 3 to the end of a fin 6 that is closest to the impeller is denoted by $R_2$, whilst the distance from the axis of impeller 3 to the end of fin 6 that is furthest away from the shaft is denoted by $R_3$. $R_4$ denotes the distance from the axis of impeller 3 to the inlet of volute 4, whilst $R_5$ denotes the distance from the shaft of impeller 3 to volute nozzle 7.

Note that the greater the distance between $R_4$ and $R_1$, the more the water flow speed will be reduced.

Fins 6 can be considered as curved partitions, preferably all having the same shape, each having a height dimension that extends generally spanwise across the outlet of the impeller, a width dimension that extends generally streamwise in the liquid flow and a thickness dimension that is smaller than the height and width dimensions. Hence, individual fins 6 are aligned with the flow of the water as it exits the impeller and enters the volute 4, the fins having a rectangular shape when viewed looking outwards from the impeller.

For each fin 6, the difference between radial distance $R_2$, from the rotational axis of impeller 3 to the end of fin 6 closest to the shaft of impeller 3, and radial distance $R_1$, from the shaft of the pump to the periphery of impeller 3, preferably represents from 1 to 10%, and more preferably from 5 to 10%, of the radial distance $R_1$. This reduces the stress on blades 8, which in turn reduces the vibrations and improves the performances of the pump.

The ratio $(R_2-R_1)/R_1$ is therefore preferably between 0.01 and 0.1, and more preferably between 0.05 and 0.1.

For each fin 6, the difference between radial distance $R_5$, from the axis of impeller 3 to the volute nozzle 7, and radial distance $R_3$, from the axis of impeller 3 to the end of fin 6 furthest from the axis of impeller 3, preferably represents from 3 to 10%, and more preferably from 3 to 7% of the radial distance $R_3$, from the shaft of impeller 3 to the end of fin 6 furthest away from the shaft of impeller 3. This arrangement enables blockage of the flow and poor outflow to be ameliorated.

Hence, the ratio $(R_5-R_3)/R_3$ is between 0.03 and 0.1, and preferably between 0.03 and 0.07.

The pump according to the invention therefore enables excessive radial thrust exerted by the water on the centrifugal impeller to be reduced whilst limiting the water flow rate in a simple and economic manner. Although FIGS. 1 and 2 illustrate fixed elements in the form of fins, the pump according to the invention is not limited to this embodiment and may comprise fixed elements with different profiles, and particularly fixed elements whose cross sections are elongated in the direction of flow of the water and perpendicularly to the previously mentioned upper and lower walls to which the fixed elements are attached.

It is understood, therefore, that this invention is not limited to the particular embodiments disclosed, but is intended to cover all modifications which are within the spirit and scope of the invention as defined by the appended claims; the above description; and/or shown in the attached drawings.

What is claimed is:

1. A concrete volute pump, comprising:

a centrifugal impeller having blades, the impeller being arranged for rotation about an axis and operable to direct a liquid towards a concrete volute arranged around the impeller, wherein the pump further comprises fixed elements arranged between the impeller and the volute, said fixed elements comprising a discontinuous barrier around the impeller, wherein for each fixed element, the difference between a radial distance from the rotational axis of the impeller to an end of the fixed element closest to the impeller, and the radial distance from the rotational axis of the impeller to an end of a blade furthest away from the axis of the impeller, represents from 1 to 10% of the radial distance from the rotational axis of the impeller to a periphery of the impeller, and wherein, for each fixed element, the difference between the radial distance from the rotational axis of the impeller to a volute nozzle and the radial distance from the rotational axis of the impeller to an end of the fixed element furthest away from the rotational axis of impeller, represents from 3 to 10% of the radial distance from the rotational axis of the impeller to said end of the fixed element furthest away from the impeller.

2. The pump according to claim 1, wherein the pump is configured to pump liquid at volume flow rates of up to at least 40 $m^3$/sec.

3. The pump according to claim 1, wherein said fixed elements comprise bodies each having a height dimension that extends generally spanwise across an outlet of the impeller, a width dimension that extends generally streamwise in a liquid flow and a thickness dimension that is smaller than the height and width dimensions.

4. The pump according to claim 3, wherein said fixed elements comprise streamwise curved partitions or fins.

5. The pump according to claim 1, wherein said fixed elements are substantially equally spaced around the impeller.

6. The pump according to claim 1, wherein said fixed elements are arranged substantially equidistantly from the rotational axis of the impeller.

7. The pump according to claim 1, wherein the number of impeller blades and the number of fixed elements are coprime.

8. The pump according to claim 1, wherein the volute is circular in cross-section.

9. The pump according to claim 1 wherein the pump is configured to pump liquid at volume flow rates of up to at least 40 $m^3$/sec.

10. The pump according to claim 1, wherein said fixed elements comprise bodies each having a height dimension that extends generally spanwise across an outlet of the impeller, a width dimension that extends generally streamwise in a liquid flow and a thickness dimension that is smaller than the height and width dimensions.

11. The pump according to claim 1, wherein the number of impeller blades and the number of fixed elements are coprime.

12. The pump according to claim 1, wherein the volute is circular in cross-section.

* * * * *